United States Patent [19]

Garcia Rodenas

[11] 3,982,628

[45] Sept. 28, 1976

[54] ETUI FOR JEWELRY

[76] Inventor: Manuel Garcia Rodenas, Salvador Lluch, 21, Valencia, Spain

[22] Filed: Mar. 26, 1975

[21] Appl. No.: 562,129

[30] Foreign Application Priority Data

Nov. 26, 1974 Spain ..... 207,851

[52] U.S. Cl. ..... 206/45.14; 206/76; 206/457

[51] Int. Cl.[2] ..... B65D 43/16; B65D 25/10

[58] Field of Search ..... 206/45.19, 45.14, 76, 206/75, 457; D9/200; D2/258

[56] References Cited

UNITED STATES PATENTS

| | | | |
|---|---|---|---|
| 483,399 | 9/1892 | Smith | 206/76 |
| 3,197,166 | 7/1965 | Sandler | 206/76 X |
| D98,906 | 3/1936 | Taien | D2/258 |
| D148,991 | 3/1948 | Jacobson | D9/200 |

*Primary Examiner*—Leonard Summer
*Attorney, Agent, or Firm*—Imirie, Smiley & Linn

[57] ABSTRACT

This etui or case for jewelry adopts exteriorly the shape of a "pamela" or woman's hat with large hat brim and with its bottom cavity closed horizontally by a wall, the case comprising two portions: one constituted by a large upwardly and downwardly bent brim surrounding the central wall, and upon which leans a lined plaque for placing a jewel, this plaque being limited by a small vertical railing surrounding it, and this plaque being provided wth a hook which passes through the lining and serves to fix a finger ring therein, maintaining it inclined, said hat brim having exteriorly a half hinge; the other portion corresponds to the crown of the hat and has the shape of a hemispherical shell having at one side the other half of the hinge to be coupled with the one of the hat brim to form an articulation, this hemispherical shell carrying a hat band placed in such a way that it overlaps the mouth and serves to cover the joining line between the crown and the brim of the hat.

4 Claims, 3 Drawing Figures

ETUI FOR JEWELRY

BACKGROUND OF THE INVENTION

When a jewel is sold in a jewelry shop it is generally delivered in cases which, even though provided with more or less attractive shapes and being lined or decorated with trimmings, always have the well known shape of a box of either rectangular, round, oval or other geometrical shape in accordance with the kind and size of the piece of jewelry to be contained therein.

On the other hand, when finger rings or bracelets are to be displayed, it is usual to place them around a projection emerging from the supporting surface, thus becoming partially unseen since the internal part of it is hidden by the supporting surface, and when not placed this way they fall off when opening the case. It is therefore desirable to improve these cases by providing them with a more agreeable and attractive appearance, and providing them at the same time with a means for holding the piece of jewelry in place without hiding it partially to the sight. However, due to ever increasing costs it is difficult to obtain jewelry cases exhibiting these features without an additional charge to the buyer.

SUMMARY OF THE INVENTION

The present invention embodies a new concept in jewelry cases, in that it comprises a case of attractive and agreeable configuration which breaks away from the monotony of the traditional and well known jewelry case in the shape of a box, since besides its function as a jewelry case, it has a great attractiveness by adopting, in miniature; the shape of an elegant article of clothing for women, thus enhancing the effect of delicacy and refinement of the eventual gift for which the contents may be intended, and further capable of being manufactured at relatively low cost.

Besides the above, the jewelry case has been provided with simple attaching means to hold the piece of jewelry, preventing it from falling off and this without hiding any of its parts, and holding it in the most appropriate position for it to be examined within the case.

Specifically, a jewelry case according to this invention has the shape of a "pamela" or woman's hat with large hat brim, constituted by two main parts: the brim and the crown of the hat. The brim has the central cavity closed by means of a horizontal wall forming a small plateau of oval configuration having a small vertical peripheral lip. The wall provides a surface on which is fixed either with adhesive or other means a plate lined with velvet or similar material, constituting the support surface for the piece of jewelry. This plate carries with it a hook which passes through the lining and serves to hold down the band of a finger ring, maintaining it inclined. The hat brim has exteriorly a half hinge.

The crown of the woman's hat is an independent piece in the general shape of a hemisphere which may be also egg-shaped, being exteriorly provided with a half hinge by means of which it is joined to the other half hinge on the hat brim, in such a way that it can be seated upon the vertical wall of said plateau, covering it and serving thus as a cover for the case, said case adopting by this means the shape of a "pamela" or woman's hat. Said crown of the hat can be raised articulately through the hinge and thus the jewelry case can be opened and the jewelry piece in the interior can be shown and exhibited.

Around the mouth of the crown of the hat there is a band displaced slightly below the edge of the crown, with the view that when closing the crown (which acts as a cover) on the brim (which acts as the case), the joining line of both parts remains concealed under the band.

The two main parts of the jewelry case, namely the brim and the crown of the hat, can be maufactured in any manner, but it will be more advantageous to have them made out of molded synthetic plastic and of any desired color.

DETAILED DESCRIPTION OF THE INVENTION

Figure 2:
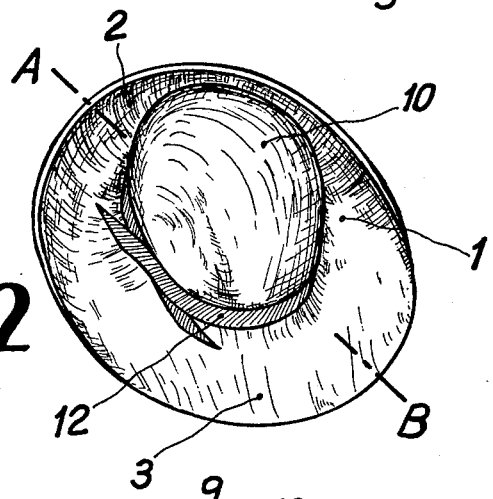
FIG. 2 is another perspective view of the jewelry case of FIG. 1, but in closed position.

A case for jewelry according to the invention, as best shown in FIG. 2, has the shape in miniature of a woman's hat of the type called "pamela", in which the bottom piece 1 imitates the large hat-brim proper of this type of hat which, in the example shown, has a portion 2 bent upwards and an opposite portion 3 lightly inclined downwards. In the center where in a real hat there would be an opening or mouth of the cavity of the crown there is a wall 4 having a horizontal position and forming on its upper face a plateau surrounded by a small vertical peripheral lip or wall 5 within which is mounted a plate 6 lined with a material 7 such as velvet and the like. On the plate 6 there is fixedly attached a block 8 carrying a hook 9 designed to receive and hold the band of a finger ring (not shown in the drawing) to maintain it in an inclined position, with the help of a rib 13 arranged in the concave side of the hook.

Figure 1:
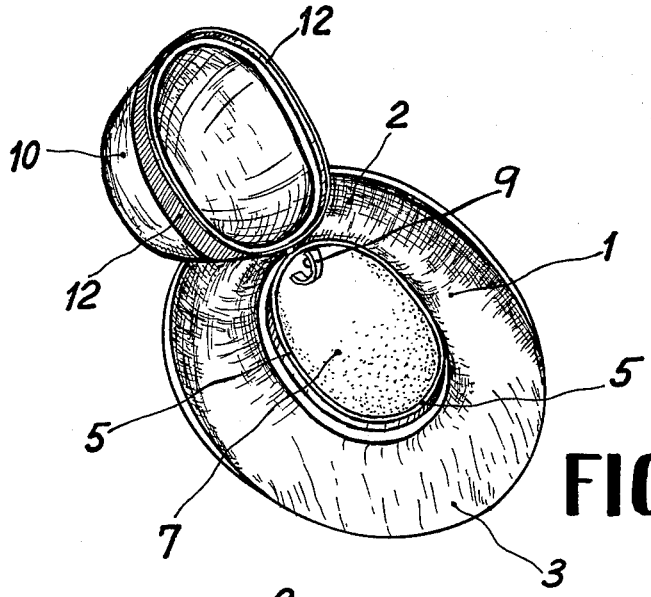
FIG. 1 is a perspective view of the jewelry case according to the invention, with the crown of the hat acting as a cover in its open or raised position.

The cover of the jewelry case is constituted by the hemispherical or egg-shaped crown 10, in the shape of the crown of a woman's hat, being attached articulately to one side of the projecting lip formed on by the wall 4, by means of a hinge 11, in such a way that it can be opened as in FIG. 1, or closed, covering the lined surface 7 and the hook 9.

Figure 3:
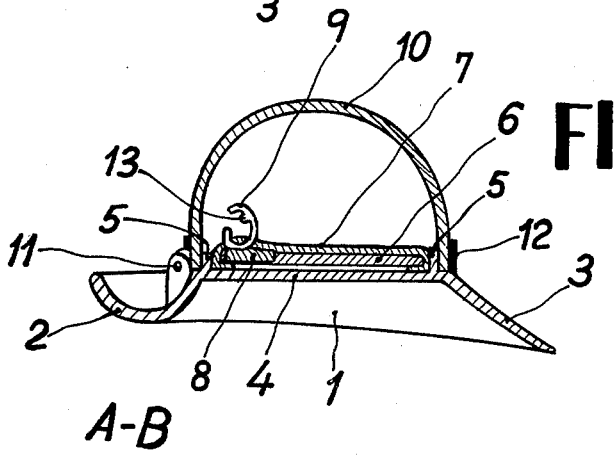
FIG. 3 is a cross sectional view through line A-B, of FIG. 2.

The case of the invention comprises also a band 12 arranged around the mouth of the crown 10 overlapping the edge, in such a way that when the crown is closed down over the brim 1, the band will conceal the contact joint of both parts, as shown in FIGS. 2 and 3 of the drawings.

The parts of the jewelry case can be produced out of any material suitable, preferably of moulded plastic and of diverse colors. Also the size can be varied so that different types of pieces of jewelry may be accomodated in the jewelry case. For instance, the size will be different according to whether it is to contain a collar, a bracelet or a finger ring; the shape also may be lightly altered while still simulating a woman's hat in miniature, and might incorporate complementary decorative elements such as flowers, feathers, fruits, figures and so forth.

I claim:

1. A jewelry case in the form of a woman's hat of the pamela type, in miniature, for containing and displaying rings, bracelets and other articles of jewelry comprising:

a round base having a substantially flat horizontal wall surrounded by a peripheral flange half of which is curved upwardly and half of which is curved downwardly in the shape of a hat brim, a substantially vertical lip extending upwardly from the periphery of said horizontal wall, a plate supported on said horizontal wall within said vertical lip on said base, a hook fixedly attached to said plate, said hook having a rib protruding from the concave side of said hook for engaging and supporting an article of jewelry in a position for display, said plate being covered with a lining material with the hook extending exteriorly through said lining material, and a half hinge on said upwardly curved half of said flange adjacent said vertical lip; and a hollow, rounded cover in the form of the crown of the hat, a hat band disposed around said cover and extending below the edge thereof, and a half hinge on said cover adjacent said edge, said half hinge of said cover cooperating with said half hinge of said base whereupon said cover may be articulated between a closed position at which said cover rests on said flange with said hat band concealing the line of contact between said cover and said base to present the apearance of a woman's hat of the pamela type, and an open position at which said cover is swung back to expose said lined plate and the article of jewelry supported thereon.

2. A jewelry case according to claim 1 wherein said horizontal wall, said peripheral flange, said vertical lip, and said half hinge of said base comprise a unitary molded plastic member.

3. A jewelry case according to claim 2 wherein said cover and said half hinge on said cover comprise a second unitary molded plastic member.

4. A jewelry case according to claim 3 wherein said cover is substantially hemispherical.

* * * * *